United States Patent [19]

Foster

[11] 3,957,445

[45] May 18, 1976

[54] ENGINE EXHAUST SYSTEM WITH MONOLITHIC CATALYST ELEMENT

[75] Inventor: Michael R. Foster, Goodrich, Mich.

[73] Assignee: General Motors Corporation, Detroit, Mich.

[22] Filed: June 12, 1974

[21] Appl. No.: 478,459

[52] U.S. Cl. ..... 23/288 FB; 23/288 FC; 60/301

[51] Int. Cl.[2] ..... B01J 8/00

[58] Field of Search ..... F01N/3/15; 23/288 F, 23/288 FB, 288 FC; 60/301, 302

[56] References Cited

UNITED STATES PATENTS

| | | | |
|---|---|---|---|
| 1,844,611 | 2/1932 | Spackman | 210/168 |
| 3,094,394 | 6/1963 | Rnnes et al. | 23/288 F UX |
| 3,211,534 | 10/1965 | Ridgway | 23/288 FC UX |
| 3,445,196 | 5/1969 | Thomas | 23/288 FC |
| 3,449,086 | 6/1969 | Rnnes | 23/288 F |
| 3,544,264 | 12/1970 | Hardison | 23/288 FB X |
| 3,730,691 | 5/1973 | Lang et al. | 23/288 FC UX |
| 3,775,064 | 11/1973 | Berger et al. | 23/288 F |
| 3,801,289 | 4/1974 | Wiley | 23/288 FC |
| 3,817,714 | 6/1974 | Wiley | 23/288 FC |
| 3,823,555 | 7/1974 | Cole | 23/288 FA UX |
| 3,824,788 | 7/1974 | Cole et al. | 23/288 FC UX |
| 3,838,977 | 10/1974 | Warren | 23/288 F |
| 3,841,842 | 10/1974 | Wiley | 23/288 FC |

*Primary Examiner*—Barry S. Richman
*Attorney, Agent, or Firm*—Robert M. Sigler

[57] ABSTRACT

An axial flow, monolithic catalyst element has one axial end abutting a seat in an exhaust manifold, which axial end also includes both inlet and outlet means to the element. The other axial end of the element includes a flow reversing cap and a load bearing member. The element is contained within a closed ended casing having an air inlet near its closed end. A spring between the closed end of the casing and the load bearing member holds the element securely against the seat. Pressurized air is forced through the air inlet and through openings in the load bearing member and the flow reversing cap for oxidation of exhaust gases within the element and cooling of the spring and load bearing member.

1 Claim, 1 Drawing Figure

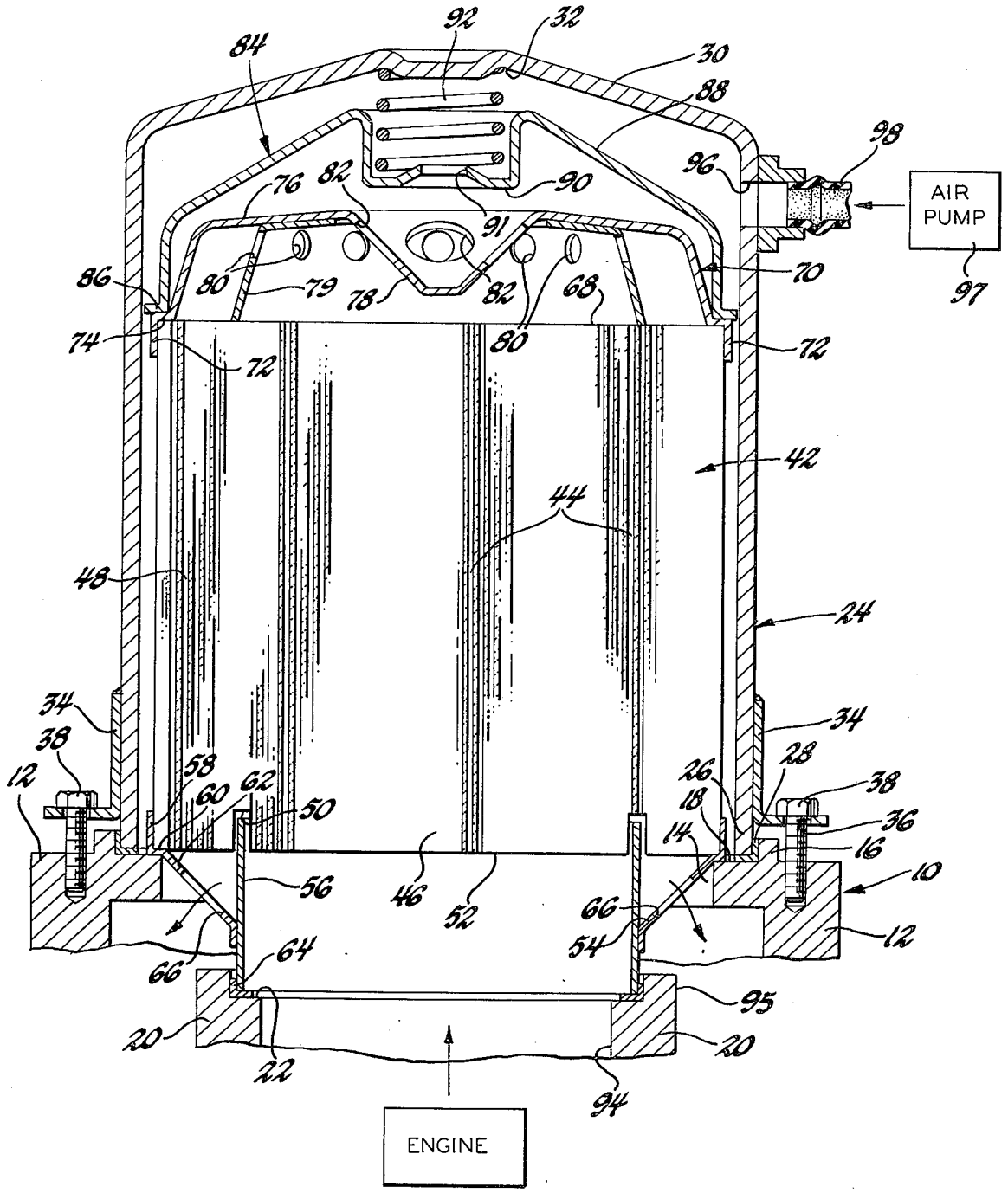
AIR PUMP
ENGINE

ENGINE EXHAUST SYSTEM WITH MONOLITHIC CATALYST ELEMENT

BACKGROUND OF THE INVENTION

My invention relates to catalytic converters for internal combustion engines and specially those with monolithic catalyst elements. A monolithic catalyst element generally comprises a catalyst substance distributed within a one piece, rigid member having an internal structure filled with numerous flow paths for the circulation of exhaust gas through the element. Such an element contained within a casing with input and output means for the exhaust gases comprises a monolithic catalytic converter.

The mounting of such an element within a casing, however, is not simple, since the catalytic converter mounted on a motor vehicle is liable to be subjected to severe shocks and vibrations with resultant chipping or breakage of the monolithic element. The element must therefore be held tightly within the casing; however, allowance must be made for the differing rates of expansion of the element substrate material and the casing over the wide range of temperatures to which catalytic converters are subjected.

A spring between the element and the casing will hold them together during shock or vibration and yet allow relative movement due to differing rates of thermal expansion. However, springs able to withstand the high temperatures encountered within catalytic converters must be made from special, high cost alloys. It is desirable to produce a spring loaded monolithic catalytic converter in which the spring is so protected from the heat within the converter that a common, low cost spring can be used.

SUMMARY OF THE INVENTION

My solution to this problem is applicable in particular to those catalytic converters having an oxidizing catalyst and to which air is supplied under pressure to aid in oxidation of the exhaust gases.

My invention comprises a monolithic catalyst element within a closed ended casing, the element being seated against a seat near the end of the casing opposite the closed end. A load bearing member near the closed end of the casing transfers force to the catalyst element from a compression spring between the load bearing member and the closed end of the casing, the force being sufficient to hold the catalyst element securely against its seat. A flow reversing or gas containing member between the load bearing member and the catalyst element prevents hot exhaust gases from impinging directly upon the load bearing member or spring. An air inlet in the casing between its closed end and the load bearing member is connected to a pressurized air source which pumps air through the air inlet and openings in the load bearing member and flow reversing member to the catalyst element, the air cooling the spring and load bearing member as it flows through and over them. Further details and advantages of my invention will be apparent from the accompanying drawing and following description of a preferred embodiment.

DESCRIPTION OF THE PREFERRED EMBODIMENT

The FIGURE shows portions of an exhaust manifold 10 which is connected to an engine, not shown, for the collection and removal of exhaust gases from the engine.

The exhaust manifold 10 has an outer wall 12 with a generally circular opening 14. On the outer surface of the outer wall 12, surrounding the opening 14, an annular bead 16 defines an annular seat 18 between it and the opening 14. An inner wall 20 of the manifold 10 defines an annular seat 22.

A generally cylindrical casing 24 has an open end 26 which bears against an annular seal 28 set in seat 18. The opposite end 30 of the casing 24 is closed and is dimpled at its axial center to form a spring seat 32 on the inside. The casing 24 has a number of L-shaped brackets 34 welded to its outside surface near its open end 26. Each of the L-shaped brackets 34 has an opening 36 through which a bolt 38 is inserted. Each bolt 38 is screwed down into the wall 12 to hold the casing 24 tightly against the seal 28 and the seal 28 tightly against the seat 18.

A cylindrical monolithic catalyst element 42 is contained within the casing 24. The element 42 comprises a rigid substrate of a ceramic material honeycombed with a large number of axial flow paths 44. The walls bordering each of these axial flow paths are coated with a catalyst material. The element 42 is generally divided into a central cylindrical region 46 in which the axial flow path walls are coated with a reducing catalyst and an outer annular area 48 within which the axial flow path walls are coated with an oxidation catalyst. An annular groove 50 is formed in the end 52 of the element 42 adjacent the manifold 12; and the boundary between the central cylindrical area 46 and the outer annular area 48 is the imaginary cylinder formed by extending the groove 50 axially through element 42.

At end 52 of the element 42 one finds exhaust conduction means comprising a pair of conduit members 54 and 56. Conduit member 54 has a cylindrical portion 58 which fits tightly around end 52 of element 42, a flange portion 60 which abuts the end 52 of member 42 and serves as a seal between element 42 and seat 18 of wall 12, and a frusto-conical portion 62, which extends into the opening 14 of the manifold 10. Conduit member 56 is a cylindrical metal tube, to the outer surface of which is welded the free end of the frusto-conical section 62. One end of conduit member 56 extends into the groove 50 in element 42 while the other end is pressed against an annular seal 64 in annular seat 22. A series of openings 66 are arranged circumferentially around the frusto-conical section 62.

At the other end 68 of element 42, a flow reversing cap or baffle 70 is located. The flow reversing cap 70, also referred to as an exhaust gas retaining member, has a cylindrical portion 72 which just fits around the element 42, a flange portion 74 which abuts the end of element 42, an annular convex portion 76 and an inner concave portion 78. A flange member 79 extends from the annular convex portion to the end 68 of element 42, meeting that end 68 at the circular boundary between central cylindrical area 46 and outer annular area 48. A circular array of openings 82 is formed in the inner concave portion 78, and another circular arrangement of openings 80 is formed in the flange portion 79.

A load bearing member 84 comprises an outer flange portion 86, an annular convex portion 88 and a central spring seat 90 surrounding a central axial opening 91. A coil spring 92 is compressed between spring seats 32 and 90; and this spring 92, reacting against the casing 24, exerts a force on the load bearing member 84 which is transmitted from the outer flange portion 86, through the flange portion 74 of the flow reversing cap 70, to the element 42. This force holds the element 42 and flange portion 60 of conduit member 56 firmly against seat 18.

In operation, exhaust gases from the engine are introduced through a passage 94 defined by inner wall 20 of the manifold 10 and the conduit member 56 to the central cylindrical area 46 of the element 42. The gases flow axially through the central cylindrical area 46, where oxides of nitrogen are chemically changed in the presence of the reducing catalyst. Upon their exit from the other end 68 of element 42, the gases are deflected radially outward by the inner concave portion 78 of the flow reversing cap 70 and forced through the openings 80. The flow reversing cap 70 thereupon deflects the gases downward, in the FIGURE, into the outer annular area 48 of the element 42. The gases flow back axially through outer annular area 48, wherein the unburned an partially burned hydrocarbons are oxidized in the presence of the oxidizing catalyst and oxygen introduced as described below. The gases emerging from the end 52 of element 42 pass through the openings 66 into a passage 95 formed in the manifold 10 between walls 12 and 20.

In order to supply additional oxygen to the exhaust gases for the oxidation reaction, an air inlet 96 is provided in the casing 24 near or in the closed end 30 and an air pump 97, normally driven by the engine, supplies pressurized air through a conduit 98 to the air inlet 96. The air flows from the air inlet 96 around and over the top surface of the load bearing member 84, around and through the spring 92, through the opening 91 in the load bearing member 84, and through the openings 82 in the flow reversing member 70. At this point it meets and mixes with the exhaust gases having just emerged from the reducing portion of the element 42 and flows with them through openings 80 into the oxidizing portion of element 42. Any air which escapes past the outer flange 86 of the load bearing member 84 remains trapped between the element 42 and casing 24, since it cannot enter element 42 from the radial side and cannot pass the flange 60 of conduit member 54, which acts as a seal. Mixing of the exhaust gases and air is aided by the flange member 79 and its openings 80, since the flange member 79 requires the exhaust gases having emerged from the reducing portion of element 42 to flow through a significant distance with the incoming air before entering the oxidizing portion of element 42.

Neither the spring 92 nor load bearing member 84 are in direct contact with hot exhaust gases; and only the outer flange portion 86 of load bearing member 84 is in contact with any other member that is directly heated by such gases. The flow reversing cap 70 prevents the exhaust gases from contacting these members. In addition, the air flowing from the air inlet 96 cools the load bearing member 84 and the spring 92 as it flows over and through them. Thus, the load bearing member 84 and spring 92, although made from common inexpensive metals, are able to maintain their strength and characteristics during normal operation of the catalytic converter.

The preceding description is of a preferred embodiment of my invention. Equivalent embodiments will occur to those skilled in the art, and therefore my invention should be limited only by the claims which follow.

I claim:

1. A catalytic converter adapted for use in an engine exhaust system with an exhaust conduit and a source of pressurized air, the catalytic converter comprising:

a generally cylindrical casing having central inlet means and peripheral outlet means at one axial end thereof, a catalyst element seat at the one end surrounding the inlet and outlet means and means at the other end adapted for admitting pressurized air source;

a cylindrical monolithic catalyst element having one axial end engaging the catalyst element seat, the catalyst element defining separate central and peripheral flow paths extending axially therethrough, the casing including conduit means engaging the one end of the catalyst element between the central and peripheral flow paths to communicate the inlet means with the central flow path for exhaust gas flow therethrough to the other end thereof and the outlet means with the peripheral flow path for exhaust gas flow therefrom to the outlet means; a flow-reversing baffle having a peripheral flange portion abutting the other end of the catalyst element, a central portion spaced from the other end of the catalyst element and an opening for the admission of air from the air admission means, the flow-reversing baffle being effective to receive exhaust gas from the other end of the central flow path and air from the air admission means and direct both into the other end of the peripheral flow path for return flow to the outlet means; a generally cup-shaped member in the casing having a peripheral flange engaging the peripheral flange of the flow-reversing baffle, a central portion spaced therefrom toward the other end of the casing, a central opening for air flow therethrough and a spring seat surrounding the opening;

and a coil spring compressed between the spring seat and the other end of the casing, whereby the catalyst element is biased against the catalyst element seat and the spring is separated from contact with exhaust gases by the flow-reversing baffle and cup-shaped member and cooled by air flowing over it from the air admission means to the catalyst element.

* * * * *